US007828532B2

(12) United States Patent
Volftsun

(10) Patent No.: US 7,828,532 B2
(45) Date of Patent: Nov. 9, 2010

(54) ROTARY VANE MACHINE

(76) Inventor: Leonid Volftsun, 414/3 Harif Street, Ofakim (IL) 80300

( * ) Notice: Subject to any disclaimer, the term of this patent is extended or adjusted under 35 U.S.C. 154(b) by 747 days.

(21) Appl. No.: 11/768,032

(22) Filed: Jun. 25, 2007

(65) Prior Publication Data

US 2007/0297928 A1 Dec. 27, 2007

(30) Foreign Application Priority Data

Jun. 25, 2006 (IL) ..... 176534

(51) Int. Cl.
*F01C 1/00* (2006.01)

(52) U.S. Cl. ..... 418/37; 418/33; 418/34; 417/204; 123/245

(58) Field of Classification Search ..... 418/33, 418/34, 35, 36, 37, 38, 68; 417/204; 123/245
See application file for complete search history.

(56) References Cited

U.S. PATENT DOCUMENTS 3,169,487 A * 2/1965 Namikawa ..... 418/34
3,483,578 A * 12/1969 Harrison ..... 418/37
4,169,697 A * 10/1979 Doundoulakis ..... 418/34
4,257,752 A * 3/1981 Fogarty ..... 418/34
5,366,356 A * 11/1994 Volftsun ..... 418/38
6,113,370 A * 9/2000 Volftsun ..... 418/38
6,210,135 B1 * 4/2001 Rassin et al. ..... 418/36
6,321,693 B1 * 11/2001 Kim et al. ..... 418/35

* cited by examiner

*Primary Examiner*—Thomas E Denion
*Assistant Examiner*—Mary A Davis
(74) *Attorney, Agent, or Firm*—Lowe Hauptman Ham & Berner LLP

(57) ABSTRACT

A rotary-vane machine, has a stationary tubular housing having a lubricated pump with an oil carter, and an oil-free section, with two pairs of ports through which a working medium enters or exits, a housing cover plate, a sun gear attached to a boss, a bearing and oil transferring member, a cover disc attachable to the end of the oil-free housing section, and a tubular rotor inside of which are fixedly attachable, two tapering vanes rotatable, together with the rotor, at a uniform speed. The machine has a first rotor end plate, attached to a drive shaft, a second rotor end plate attached to the rotor, a hollow oscillatable main shaft in bearings in the first and second end plates is concentric with the rotor, two substantially flat vanes fixedly attached to opposite sides of the hollow shaft define with, the hollow shaft, the tubular rotor, the tapering vanes and the first and second end plates, four chambers, a shaft rotatable in bearings mounted in the second end plate, and a connecting rod having a big end and a small end. The big and small ends are associated with the eccentrics and a rocker arm attached to the reduced main shaft end. Drive shaft rotation at uniform speed rotates the rotor at the same uniform speed, while oscillatory motion is superposed on the hollow shaft, whereby the chambers to successively vary between minimum and maximum volume.

18 Claims, 7 Drawing Sheets

ROTARY VANE MACHINE

RELATED APPLICATIONS

The present application is based on, and claims priority from, Israel Application No. 176,534, filed Jun. 25, 2006, the disclosure of which is hereby incorporated by reference herein in its entirety.

FIELD OF THE INVENTION

The present invention relates to a rotary-vane machine (RVM) useable as a blower, as a one-stage air or gas compressor, as a separate pressure stage in multistage air or gas compressor plants, including plants for gas liquification, for a wide range of cooling machines and for combustible gas mains, as a vacuum pump, a liquid pump and as a pneumatic or hydraulic motor, and will be referred to as HADMI RVM.

A first embodiment of the HADMI RVM according to the invention produces pressure ratios of 1.4 to 3, while a second heavy-duty embodiment is capable of producing one-stage pressure ratios of 2 to 6, particularly useful in gas compressor plants and in the cooling industry, which works with mediums having lower adiabatic coefficients.

BACKGROUND OF THE INVENTION

Conventional low-pressure compressors producing pressure ratios of 1.8 to 2.1 are characterized by low efficiency, large dimensions, weight and prime costs.

A rotary-vane blower disclosed in U.S. Pat. No. 6,113,370 which has a tubular rotor rotating at uniform speed to which are fixedly attached two first vanes. Two second vanes, forming with the first vanes four chambers for the working medium, perform inside the tubular rotor an oscillatory movement whereby the volume of the chambers is alternatively reduced and increased. This oscillatory movement is produced by a camming mechanism driven by the main shaft. While this blower works at an efficiency much higher than that of conventional blowers of all types, the camming mechanism with its high contact pressure is a serious drawback when high overpressures and high pressure ratios are desired.

Another known rotary-vane device is the Kauertz engine, in which the oscillating motion is obtained by a planetary gear arrangement including large and heavy overhanging cranks and levers, and including heavy vanes, all having large moments of inertia which, given the relatively high speeds of internal-combustion engines, produce intolerably high inertial loading, strictly limiting RPM and substantially impairing the usefulness of this design.

DISCLOSURE OF THE INVENTION

It is thus one of the objects of the present invention to overcome the drawbacks and disadvantages of the prior art devices and to provide a mechanically efficient HADMI RVM generating minimal inertial forces, and thus, safely operatable at high speed.

In accordance with the invention, this is achieved by a rotary-vane machine, comprising a stationary, tubular housing having two sections constituted by a first section containing oil and a second, oil-free section and two pairs of ports through which a working gas may enter or exit, a housing cover plate fixedly attachable to the end of said first section and provided with a central boss member located inside said housing, a sun gear fixedly attached to said boss member, a cover disc fixedly attachable to the end of said second section and adapted to define, together with said cover plate, the longitudinal axis of said tubular housing, a tubular rotor to the inside of which are fixedly attachable two tapering vanes rotatable, together with said rotor, at a uniform speed, said rotor being provided with four ports through which a working gas may enter or exit, a first rotor end plate fixedly attached to said rotor or to its tapering vanes, a drive shaft fixedly attached to, or integral with, said first end plate connectable to an external source of rotary power and supported by at least one ball bearing located in said cover disc, a second rotor end plate fixedly attached to said rotor or to its tapering vanes and having two diametrically opposite projections, a support ring, having two post-like projections, fixedly connectable via adjustment shims to the two projections of said second end plate, a hollow oscillatable main shaft mounted in bearings seated in said first end plate, said second end plate and said housing cover plate, and being concentric with said rotor, said main shaft having a solid end of a reduced diameter, two substantially tapering vanes fixedly attached to either side of said hollow shaft by means of rods, and defining with said hollow shaft, said tubular rotor, said tapering vanes and said first and second end plates, four chambers, at least one shaft unit which rotates in bearings mounted in said second end plate and said support ring respectively, each shaft unit having attached thereto or integral therewith, an eccentric or a crank-like section, and a planet gear, at least one connecting rod having a big end and a small end, the big end being associated with said eccentrics and the small end being associated via pivots with a rocker arm pinned to said reduced main shaft end, wherein rotation of said drive shaft at a uniform speed causes said rotor, including said tapering vanes, to be rotated at the same uniform speed, while an oscillatory motion is superposed on said hollow shaft and said tapering vanes, whereby the volume of said four chambers is made to successively vary between a minimum and a maximum.

The invention further provides a rotary-vane machine, comprising a stationary, tubular housing having two different diameter sections constituted by a first section containing oil and a second, oil-free section, a housing cover plate fixedly attachable to the end of said first section and provided with a central boss member located inside said housing, a sun gear fixedly attached to said boss member, a tubular rotor to the inside of which are fixedly attachable at least two tapering vanes, rotatable together with said rotor, at a uniform speed, a first end plate fixedly attachable to said rotor or its tapering vanes and having four ports through which a working gas may enter or exit, a drive shaft pinned or made integral with said first end plate and adapted to be connected to an external source of rotary power, a stationary flange member fixedly attachable to the end of said second section and provided with two pairs of ports through which a working gas can enter or exit and adapted to define together with said cover plate a longitudinal axis of said tubular housing, a second rotor end plate fixedly attached to said rotor or to its tapering vanes and having two diametrically opposite projections, a support ring mounted on said boss member and having two post-like projections fixedly connectable via adjustment shims to the two projections of said second rotor end plate, a hollow oscillatable main shaft mounted in bearings seated in said first end plate, said second end plate and said housing cover plate and being concentric with said rotor, said hollow main shaft having a solid end portion of a reduced diameter, two wedge-like vanes fixedly attached to either side of said hollow shaft by means of rods and defining with said hollow shaft, said tubular rotor, said tapering vanes and said first and second end plates, four chambers, at least one shaft unit which rotates in bearings mounted in said second end plate and said support ring respectively, each shaft unit having attached thereto or integral therewith, an eccentric or a crank-like section, and a planet gear, at least one connecting rod having a big end and a small end, the big end being associated with said eccentrics and the small end being associated via pivots with a rocker arm pinned to said reduced main shaft end, wherein rotation of said drive shaft at a uniform speed causes said rotor, including said tapering vanes, to be rotated at the same uniform speed, while an oscillatory motion is superposed on said hollow shaft and said wedge-like vanes, whereby the volume of said four chambers is made to successively vary between a minimum and a maximum.

BRIEF DESCRIPTION OF THE DRAWINGS

The invention will now be described in connection with certain preferred embodiments with reference to the following illustrative figures, so that it may be more fully understood. With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAILED DESCRIPTION OF PREFERRED EMBODIMENTS

Figure 1:
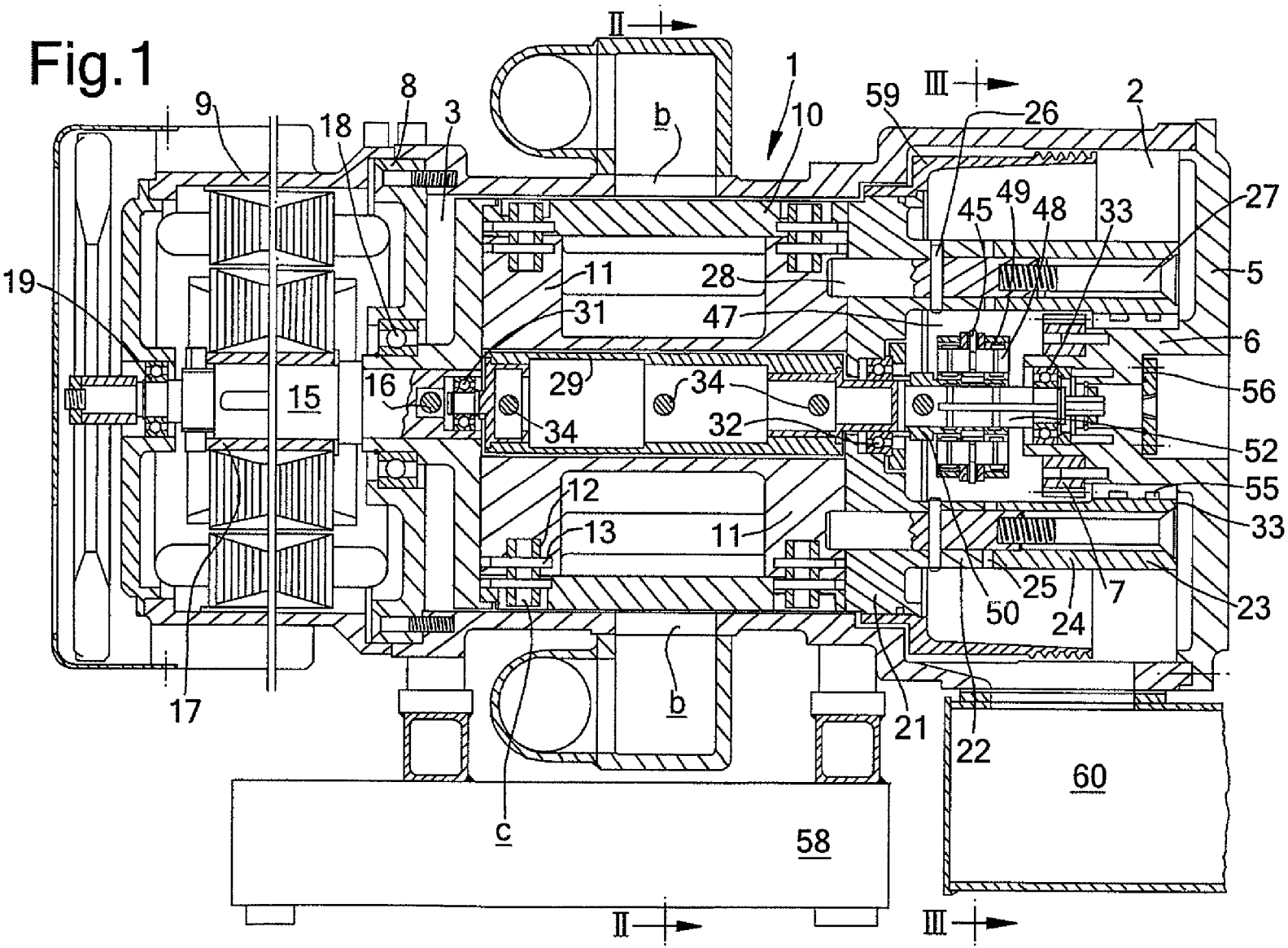
FIG. 1 is a general view in longitudinal cross-section of a first embodiment of the rotary-vane machine, according to the present invention.
Figure 2:
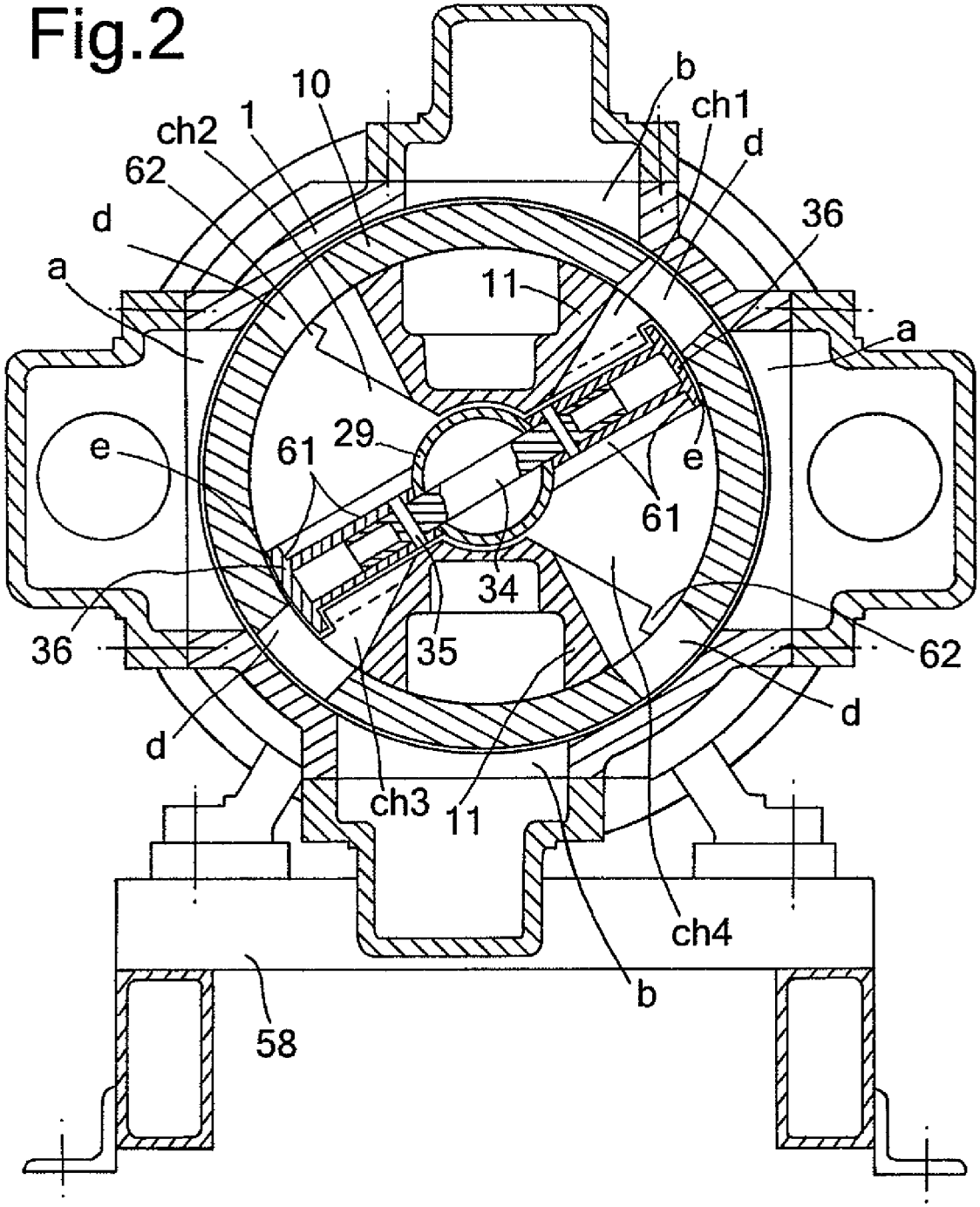
FIG. 2 is a cross-section along plane II-II of FIG. 1.

Referring now to the drawings, there is seen in FIGS. 1 and 2 a stationary, substantially tubular housing 1 with two different sections 2 and 3, section 2 containing oil and section 3 being oil-free. There is further seen in FIGS. 1 and 2, two outlet ports b opening into a machined, cylindrical surface 4 of section 3. Another two ports, inlet ports a are seen in FIG. 2, as well as ports b, opening into the same section of surface 4. Returning to FIG. 1, there is seen a cover member 5 with a central boss 6 to which is fixedly attached a sun gear 7. To the other end of housing 1 is attached a cover disk 8 with which is concentric the housing 9 of an electric motor 17.

Tubular rotor 10 includes two tapering vanes 11 (seen to better advantage in FIG. 2) each of which is fixedly attached to rotor 10 by fasteners (not shown), as well as by two cylindrical locators 12 that have an internal bore c intended to facilitate the preparation, after assembling of rotor 10, including vanes 11, of holes for bars 28 that couple end plate 21 and rotor 10. Tubular rotor 10 is also provided with four ports d which during rotation, successively pass across, and communicate with, ports a and b.

End plate 14 is fixedly attached to rotor 10 or vanes 11 by per-se known fastening means (not shown).

Drive shaft 15 is fixedly attached to end plate 14 through pin 16. Electric motor 17 mounted on shaft 15 is supported by bearings 18 and 19.

End plate 21 is provided with two projections 22 and is fixedly attached to rotor 10 and/or vanes 11 by known fastening means (not shown).

Figure 3:
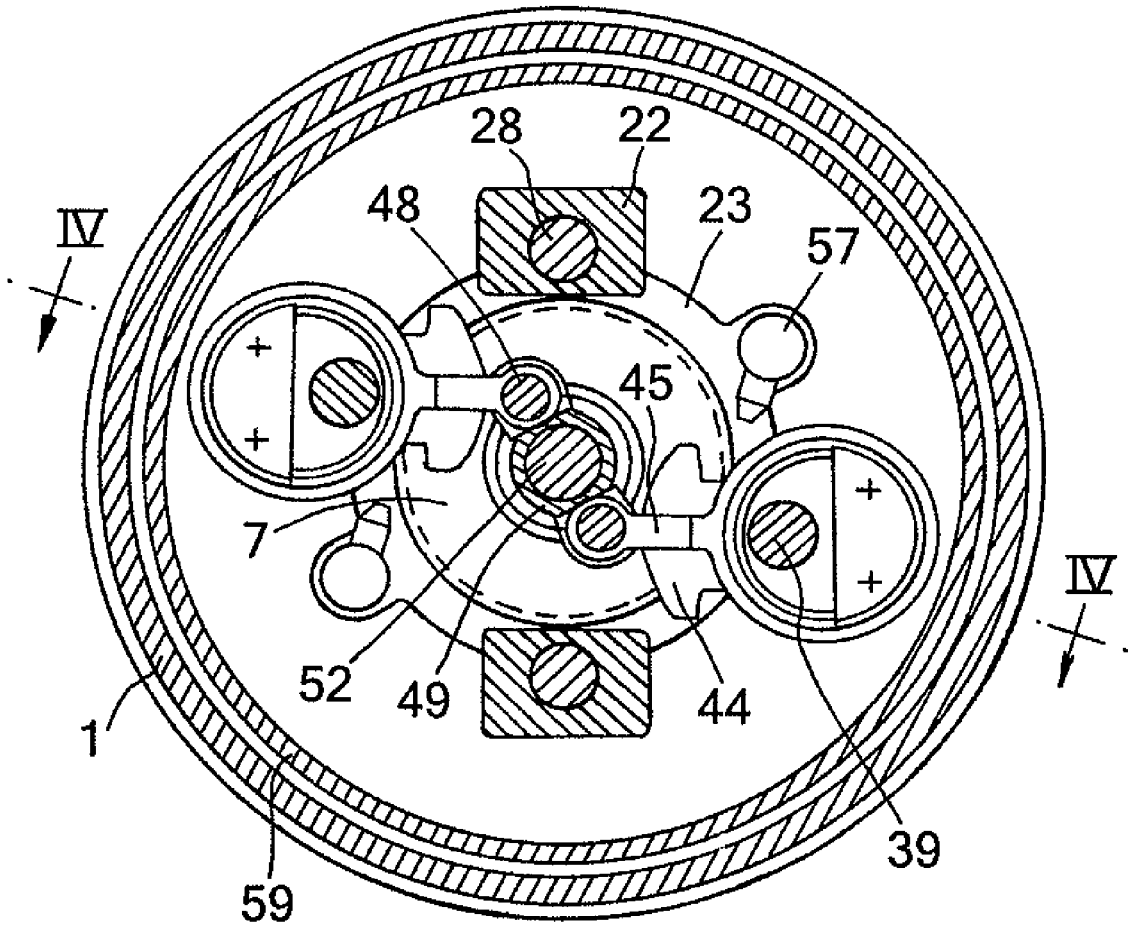
FIG. 3 is a cross-section along plane III-III of FIG. 1.

Support plate 23, seen to better advantage in FIG. 3 is also provided with two projections 24 which, in assembly, are contiguous with projections 22, being separated only by shims 25 for adjustment. Support plate 23 is fixedly attached to projections 22 by means of two screws 27 that are threaded into bars 28, which in turn are fixed in projections 22 by pins 26. Bars 28 ensure concentricity of rotor 11, support ring 23 and end plate 21.

FIG. 1 also shows a hollow, oscillating shaft 29, which is supported in bearing 31 mounted in end plate 14, bearing 32 mounted in end plate 21, and bearing 33 mounted in central boss 6. To hollow shaft 29 are fixedly attached two substantially flat vanes 36 by means of rods 34 and pins 35 (see FIG. 2).

Tapering vanes 11 and flat vanes 36 define between them and the inside of rotor 10 four chambers $Ch_1$, $Ch_2$, $Ch_3$ and $Ch_4$ (see FIG. 2), the function of which will become apparent further below.

Figure 4:
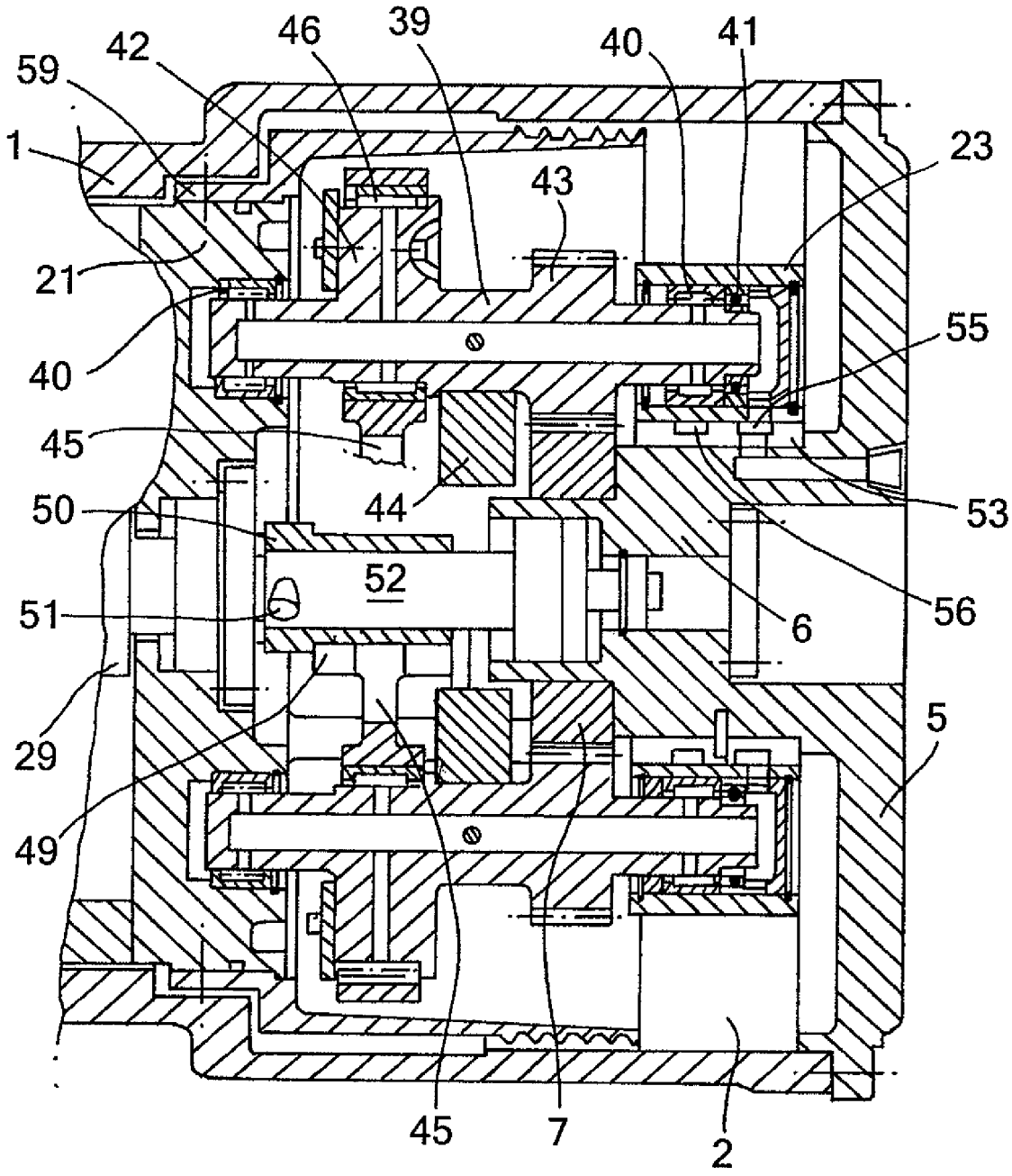
FIG. 4 is a cross-second along plane IV-IV of FIG. 3.

In FIGS. 3 and 4, there are seen two shaft units 39 supported in bearings 40 mounted in end plate 21 and in bearings 40 and 41 mounted in support ring 23. To these units are fixedly attached or are integral with eccentrics 42 and planet gears 43, which mesh with sun gear 7. Also seen are counterweights 44 that compensate for he imbalance produced by eccentrics 42.

Further seen are two connecting rods 45, the big end of which is connected via bearings 46 to each of the eccentrics 42, and the small end of each of which is connected via bearings 47 and pivot 48 to rocker arm unit 49, the sleeve 50 is pinned by means of pin 51 to the solid, reduced-diameter part of oscillating shaft 29 (see also FIG. 1).

Eccentrics 42 could also be replaced by a per-se known crank design.

In FIGS. 1 and 4 there is seen a sliding bearing 53 pinned to boss 6 and supporting rotor 10 through end plate 21 and support ring 23. Bearing 53 has a first circumferential groove 55 for lubricating the bearings of shaft unit 39, and a second groove 56 for lubricating planet gear 43 and sun gear 7 through nozzles 57 (FIG. 3). In FIG. 1 there is also seen a chassis 58 which raises the RVM sufficiently to accommodate an oil carter 60 into which an oil stripper 59 can divert the lubricant, and thus, prevent oil contamination of the compressed working gas.

Figure 5:
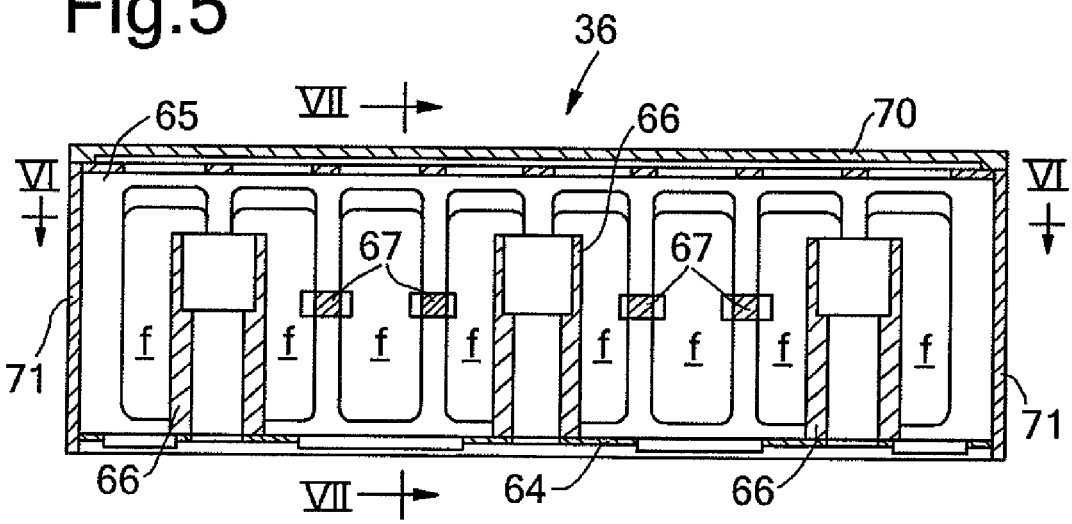
FIG. 5 is a general view in longitudinal cross-section of the substantially flat vane.
Figure 6:
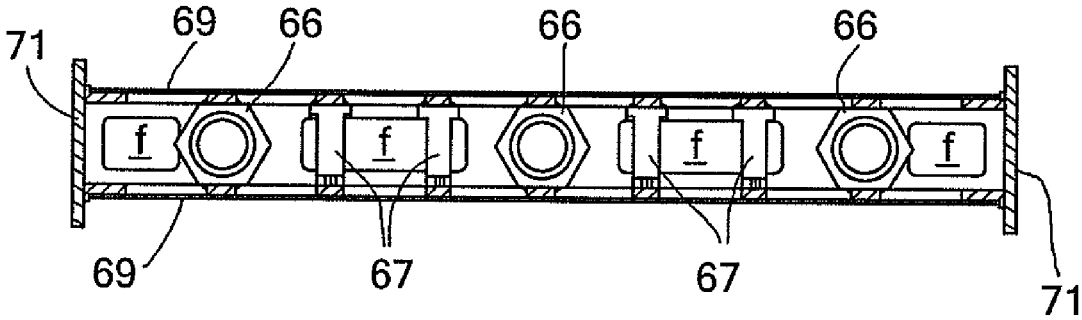
FIG. 6 is a cross-section along plane VI-VI of FIG. 5.
Figure 7:
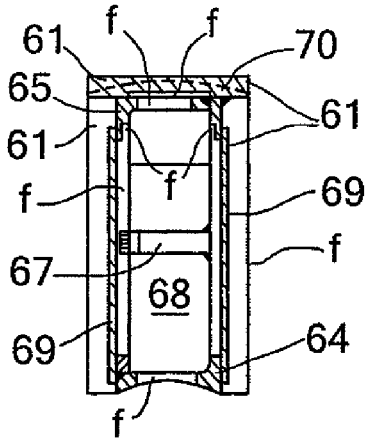
FIG. 7 is a cross-section along plane VII-VII of FIG. 5.

FIG. 2 shows small clearances e between vanes 36 and rotor 10 (with analogous clearances between vanes 36 and end plates 14 and 21, not shown), as well as the edges of thin metal sheets 61, which are wider than the body proper of vanes 36. Recesses 62 and slots (not shown) are provided in tapered vanes 11 (FIG. 2) accommodating these sheets 61, while enabling full reduction of volumes of chambers $Ch_1$ to $Ch_4$. For minimal weight and, thus, minimal inertia, vanes 36 are fabricated from aluminum alloy profiles 64 and 65, as shown in FIGS. 5, 6 and 7, and include tubular posts 66 for pins 34 (FIGS. 1 and 2) and bridging portions 67, as well as weight-reducing windows f. Windows are covered with thin sheet metal 69 and those sides of the vanes that face rotor 10 and end plates 14, 21 (FIG. 1) are provided with metal strips 70 and 71 and are machined when vanes 36 are already attached to hollow shaft 29 with pins 34 and 35. The final contour of strip 70 is indicated by a dashed line in FIG. 7.

The HADMI RVM described in detail in the aforegoing functions as follows:

Electric motor 17 drives drive shaft 15, end plate 14, tubular rotor 10 including tapering vanes 11, end plate 21 and support ring 23 at uniform speed. Two shaft units 39 disposed symmetrically relative to the RVM axis also rotate at that uniform speed. Integral with shaft units 39 are planet gears 43 meshing with stationary sun gear 7 and forcing shaft unit 39 to rotate also about their own axes at a speed that is twice as large as the speed of the RVM. Integral with shaft units 39, two eccentrics 42, via connecting rods 45, rock rocker arm unit 49, thus, via shaft end 50 superposing an oscillatory motion on hollow shaft 29, causing the latter to force flat vanes 36, which rotate together with the above RVM components, to simultaneously rock between the two tapering vanes 11 and to change the respective volumes of working chambers $Ch_1$, $Ch_2$, $Ch_3$ and $Ch_4$.

If in FIG. 2 rotor 10 rotates in the clockwise direction, the working gas enters chambers $Ch_1$, and $Ch_3$, the volumes of which are at that moment increasing, through the two ports d in rotor 11, communicating with two ports a in housing 1, and exits chambers $Ch_2$ and $Ch_4$, the volumes of which are at that moment decreasing, through the two ports d in rotor 11, communicating with ports b in housing 1.

Figure 8:
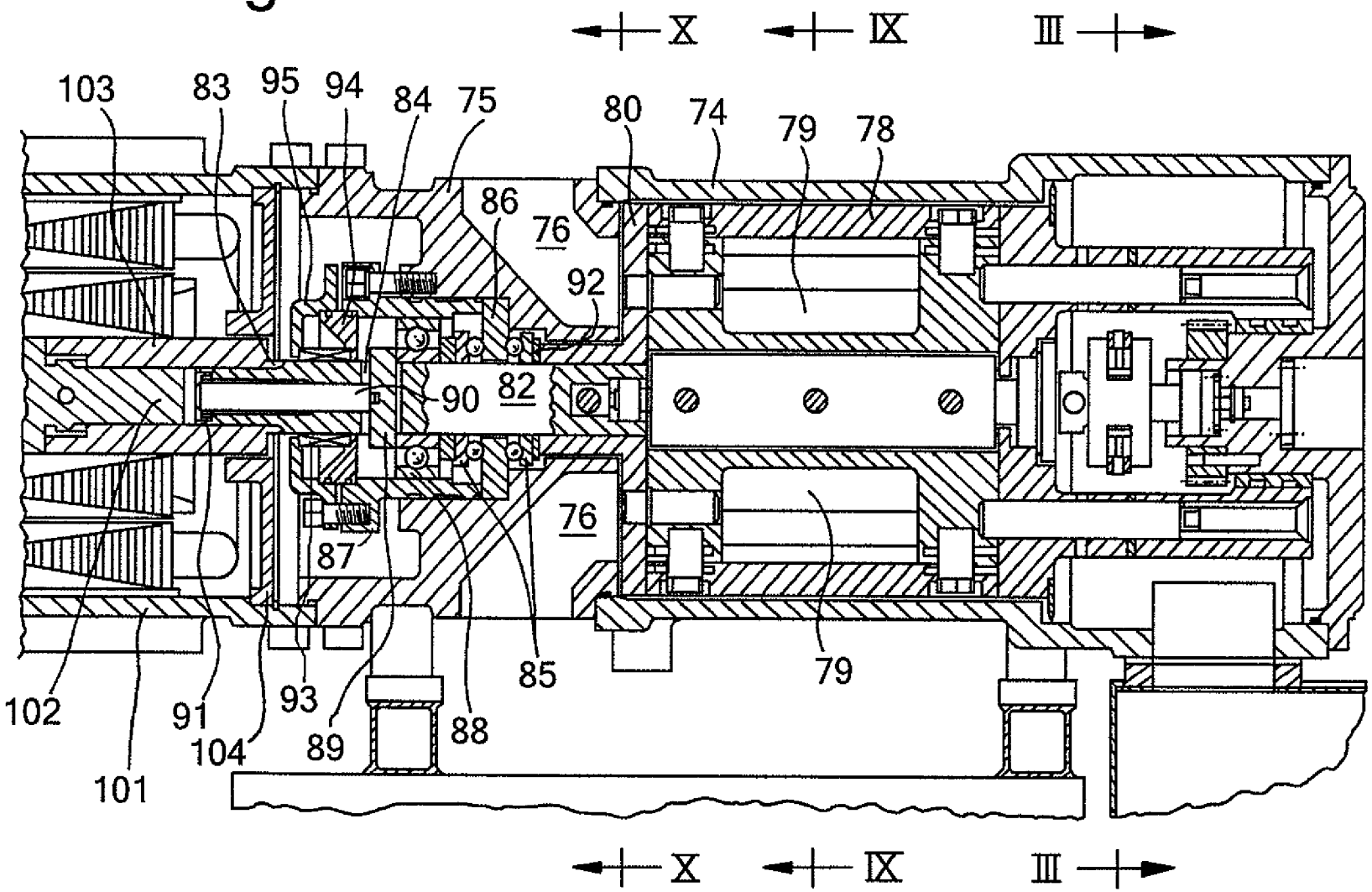
FIG. 8 is a general view in longitudinal cross-section of a second embodiment of the rotary-vane machine, according to the present invention.
Figure 9:
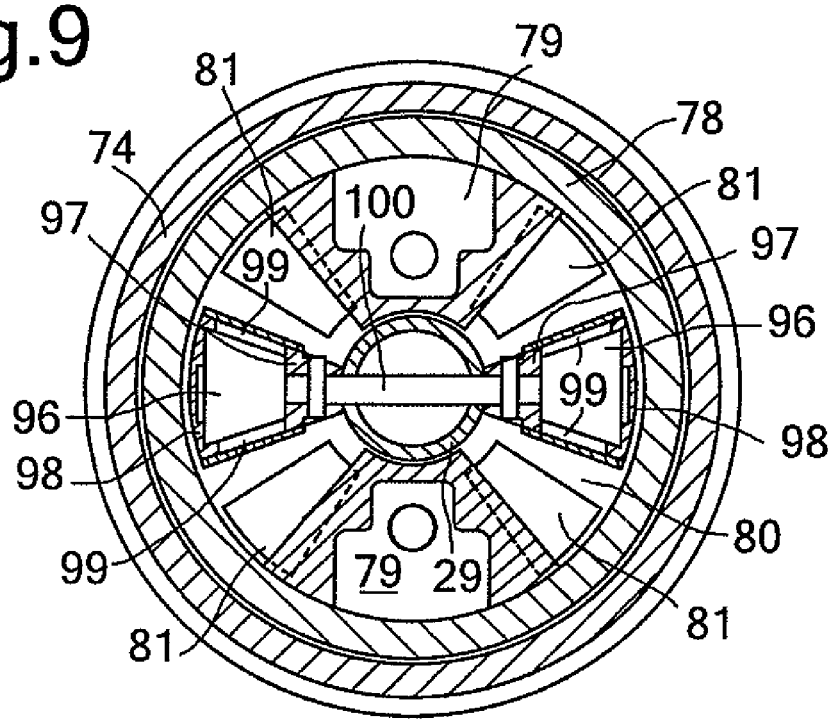
FIG. 9 is a cross-section along plane IX-IX of FIG. 8.
Figure 10:
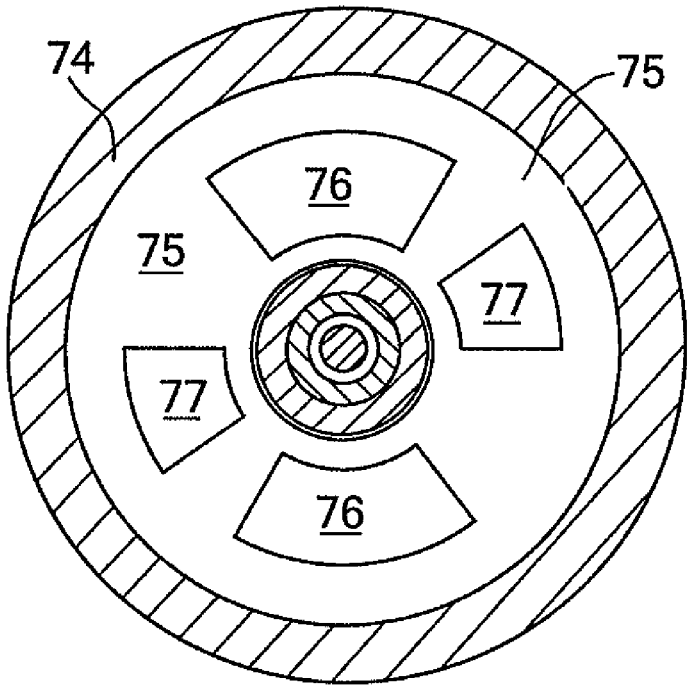
FIG. 10 is a cross-section along plane X-X of FIG. 8.

Another embodiment of the RVM according to the present invention is illustrated in FIGS. 8, 9 and 10. This is a heavy-duty design, capable of producing pressure ratios of 2 to 6.

There is seen in FIG. 8 a housing 74, a flange 75 comprising two inlet ports 76 and two outlet ports 77 seen to better advantage in FIG. 10, a rotor 78 with two rotor vanes 79, a first end plate 80 with four inlet and outlet ports 81 (see FIG. 9) and a drive shaft 82 provided with a splined surface 83 and a transversal slot 84. Further seen is a double thrust bearing 85 with a larger intermediate washer 86 seated in flange 75 and held in position by a flange 87. Also seen is a radial bearing 88, a prismatic block 89 passing through slot 84, which by means of screw 90 lockable by counternut 91 can be pressed against the bearing assembly to adjust the clearance between the flange 75 and the end plate 80, with shims 92 permitting such adjustment.

Also seen in FIG. 8 is a stuffing box 93 mounted between flanges 94 and 95, designed to prevent lubricant from bearings 85 and 88 penetrating into the electric motor.

While the oscillating vanes 36 of the first embodiment are substantially flat, vanes 96 of the present embodiment are wedge-shaped, as can be seen in FIG. 9. Further shown are the wedge bodies 97 cast or fabricated, the head pieces 98 and the cover plates 99. As in the previous embodiment, vanes 96 are pinned to rods 100.

Further seen in FIG. 8 is motor housing 101, shaft 102 of the motor, splined coupling sleeve 103 and technological flange 104, the whole purpose of which is to facilitate assembly of the electric motor and the RVM.

It will be appreciated that as opposed to the first embodiment of the invention, the present embodiment provides no ports in rotor 78, all ports being located in end plate 80 (FIG. 9).

All unnumbered parts are identical to the parts having identical functions in the first embodiment.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rotary-vane machine, comprising:

a stationary tubular housing having a pump lubricated section including an oil carter, and an oil-free section, having two pairs of ports through which a working medium can enter or exit;

a housing cover fixedly attachable to the pump lubricated housing section;

a central boss member associated with the housing, the housing comprising the stationary tubular housing and the housing cover;

a sun gear fixedly attached to said central boss member;

a united or separated central bearing and oil transferring member, which are mounted on said central boss member or on a hub of said sun gear;

a cover disc fixedly attachable to the end of said oil-free housing section, or integral therewith, adapted to define, together with said central boss member, the longitudinal axis of said tubular housing;

a tubular rotor to the inside of which are fixedly attachable, or integrally with, two tapering vanes rotatable, together with said tubular rotor, at a uniform speed, said tubular rotor including four ports through which a working medium can enter or exit;

a first rotor end plate fixedly attached to said tubular rotor or to its tapering vanes;

a drive shaft fixedly attached to, or integral with, said first end plate, supported by at least one bearing located in said cover disc, and adapted to carry an electrical motor rotor or to be connected with an external source of rotary power;

a second rotor end plate fixedly attached to said tubular rotor or to its tapering vanes and a support ring mounted on said central boss member or on the hub of the sun gear via said central bearing, said second rotor end plate and said support ring being joined together via at least two projections;

a hollow main shaft oscillatably mounted in main shaft bearings seated in said first end plate and said second end plate, and being concentric with said tubular rotor, said hollow main shaft having a solid end of a reduced diameter;

two substantially flat vanes fixedly attached to opposite sides of said hollow shaft by rods, and defining with said hollow shaft, said tubular rotor, said tapering vanes and said first and second end plates, four chambers;

at least one shaft unit for rotating in crank shaft bearings mounted in said second end plate and said support ring respectively, each shaft unit having attached thereto or integral therewith, an eccentric or a crank section, and a planet gear;

at least one connecting rod having a big end and a small end, the big end being associated with said eccentrics and the small end being associated via pivots with a rocker arm fixedly attached to said reduced hollow main shaft end, wherein rotation of said drive shaft at a uniform speed causes said tubular rotor, including said tapering vanes, to be rotated at the same uniform speed, while an oscillatory motion is superposed on said hollow main shaft and said tapering vanes, for causing the volume of said four chambers to successively vary between a minimum and a maximum.

2. A rotary-vane machine, comprising:

a stationary, tubular housing having a pump lubricated section, including an oil carter and an oil-free section;

a housing cover fixedly attachable to the pump lubricated housing section;

a central boss member associated with the housing, the housing comprising the stationary tubular housing and the housing cover;

a sun gear fixedly attached to said central boss member;

a united or separated central bearing and oil transferring member, which are mounted on said central boss member or on a hub of said sun gear;

a tubular rotor to the inside of which are fixedly attachable at least two tapering vanes, arranged to rotate together with said tubular rotor, at a uniform speed;

a first end plate fixedly attachable to said tubular rotor or its tapering vanes and having four ports through which a working medium can enter or exit;

a drive shaft fixedly attached, or made integral with, said first end plate and adapted to be supported or carried by an electrical motor rotor or be connected with an external source of rotary power;

a stationary flange member fixedly attachable to the end of said oil-free housing section, or integral therewith, and provided with two pairs of ports through which a working medium can enter or exit and adapted to define together with said central boss member a longitudinal axis of said tubular housing;

a second rotor end plate fixedly attached to said tubular rotor or to its flat vanes and a support ring mounted on said central boss member or on the hub of said sun gear via said central bearing, said second rotor end plate and said support ring being joined via at least two projections;

a hollow oscillatable main shaft mounted in main shaft bearings seated in said first end plate, and said second end plate and being concentric with said tubular rotor, said hollow main shaft having a solid end portion of a reduced diameter;

two wedge or substantially flat vanes fixedly attached to either side of said hollow main shaft by rods and defining with said hollow main shaft, said tubular rotor, said tapering vanes and said first and second end plates, four chambers;

at least one shaft unit for rotation in crank shaft bearings mounted in said second end plate and said support ring respectively, each shaft unit having attached thereto or integral therewith, an eccentric or a crank section, and a planet gear;

at least one connecting rod having a big end and a small end, the big end being associated with said eccentrics and the small end being associated via pivots with a rocker arm fixedly attached to said reduced hollow main shaft end, wherein rotation of said drive shaft at a uniform speed causes said tubular rotor, including said tapering vanes, to be rotated at the same uniform speed, while an oscillatory motion is superposed on said hollow main shaft and said wedge or substantially flat vanes, for causing the volume of said four chambers to successively vary between a minimum and a maximum.

3. The rotary-vane machine as claimed in claim 1, wherein said drive shaft is arranged to rotate the at least one shaft unit coupled with said planet gears by said tubular rotor.

4. The rotary-vane machine as claimed in claim 1, wherein said at least one shaft unit coupled with said planet gears include separate or integral fly-wheels counter-weights.

5. The rotary-vane machine as claimed in claim 1, wherein pump lubricated housing section has a greater inner diameter than said oil-free housing section.

6. The rotary-vane machine as claimed in claim 1, wherein said tubular rotor includes oil strippers adapted to divert surplus lubricant in said oil carter.

7. The rotary-vane machine as claimed in claim 2, further including a lockable arrangement having a counter-nut screw passing through said drive shaft and prismatic blocks, to squeeze together said first end plate, radial bearing inner ring and double thrust bearing, whose intermediate ring is located in said flange member, the lockable arrangement being arranged for maintaining and adjusting a small clearance between said stationary flange member and said first end plate with a compensator.

8. The rotary-vane machine as claimed in claim 1, wherein the bearings disposed in said oil-free section are grease-filled and sealed, while the bearings disposed in the pump lubricated section are given positive lubrication by means of a pump.

9. The rotary-vane machine as claimed in claim 1, wherein each of said flat and wedge vanes has a frame body made by welding means from punched profiles or by casting, said body after machining is covered with thin metal sheets by welding, brazing, soldering or gluing, some of said sheets are machine finished after fastening of said vanes to said hollow main shaft.

10. The rotary-vane machine as claimed in claim 1, wherein the end-plates-facing sides of said flat vanes are covered with thin metal sheets wider than the body proper of said vanes, and wherein slots are in said tapering vanes to accommodate said sheets while enabling full reduction of volumes of said chambers.

11. The rotary-vane machine as claimed in claim 1, wherein in each of said tapering vanes there is pressed and pinned at least one locator member dividing said vanes into two symmetrical parts and having adjusting and thread surfaces at its end portions.

12. The rotary-vane machine as claimed in claim 2, wherein said drive shaft is arranged to rotate the at least one shaft unit coupled with said planet gears by said tubular rotor.

13. The rotary-vane machine as claimed in claim 2, wherein said at least one shaft unit coupled with said planet gears include separate or integral fly-wheels counter-weights.

14. The rotary-vane machine as claimed in claim 2, wherein said pump lubricated housing section has a greater inner diameter than said oil-free housing section.

15. The rotary-vane machine as claimed in claim 2, wherein said tubular rotor includes oil strippers adapted to divert surplus lubricant in said oil carter.

16. The rotary-vane machine as claimed in claim 2, wherein the bearings disposed in said oil-free section are grease-filled and sealed, while the bearings disposed in the pump lubricated section are given positive lubrication by means of a pump.

17. The rotary-vane machine as claimed in claim 2, wherein each of said flat and wedge vanes has a frame body made by welding means from punched profiles or by casting, said body after machining is covered with thin metal sheets by welding, brazing, soldering or gluing, some of said sheets are machine finished after fastening of said vanes to said hollow main shaft.

18. The rotary-vane machine as claimed in claim 2, wherein in each of said tapering vanes there is pressed and pinned at least one locator member dividing said vanes into two symmetrical parts and having adjusting and thread surfaces at its end portions.

* * * * *